US012245713B2

(12) United States Patent
Lee et al.

(10) Patent No.: US 12,245,713 B2
(45) Date of Patent: Mar. 11, 2025

(54) BODY PILLOW

(71) Applicant: FRIDABABY, LLC, Miami, FL (US)

(72) Inventors: Stella Lee, Los Angeles, CA (US); Chelsea Hirschhorn, Miami, FL (US)

(73) Assignee: FRIDABABY, LLC, Miami, FL (US)

( * ) Notice: Subject to any disclaimer, the term of this patent is extended or adjusted under 35 U.S.C. 154(b) by 469 days.

(21) Appl. No.: 17/579,304

(22) Filed: Jan. 19, 2022

(65) Prior Publication Data

US 2023/0225528 A1 Jul. 20, 2023

(51) Int. Cl.
*A47G 9/10* (2006.01)
*A47C 20/02* (2006.01)

(52) U.S. Cl.
CPC ..... *A47G 9/1045* (2013.01); *A47C 20/025* (2013.01); *A47G 9/1036* (2013.01); *A47G 9/109* (2013.01)

(58) Field of Classification Search
CPC ..... A47C 20/02; A47C 20/025; A47G 9/109; A47G 9/10
See application file for complete search history.

(56) References Cited

U.S. PATENT DOCUMENTS

| | | | | |
|---|---|---|---|---|
| 2,521,530 | A | 9/1950 | Mcguffage | |
| 3,140,497 | A | 7/1964 | Carswell | |
| 3,459,179 | A | 8/1969 | Olesen | |
| 4,011,611 | A | 3/1977 | Lederman | |
| 4,425,676 | A | 1/1984 | Crane | |
| 4,607,403 | A | 8/1986 | Alivizatos | |
| 4,689,844 | A | 9/1987 | Alivizatos | |
| 4,873,736 | A | 10/1989 | Sapp et al. | |
| 5,070,558 | A | 12/1991 | Fenley | |
| 5,899,049 | A | 5/1999 | Fuss et al. | |
| 6,498,198 | B2 | 12/2002 | Pearce | |
| 6,499,164 | B1 * | 12/2002 | Leach | A47C 20/023 5/652 |
| 6,795,990 | B1 | 9/2004 | Hutchinson | |
| 7,010,821 | B1 | 3/2006 | Leach | |
| 7,055,196 | B2 | 6/2006 | Littlehorn | |
| 7,322,061 | B2 | 1/2008 | Carroll | |

(Continued)

FOREIGN PATENT DOCUMENTS

| | | | | |
|---|---|---|---|---|
| AU | 2004100413 A4 * | 7/2004 | ..... | A47C 20/021 |
| CA | 2839612 A1 * | 8/2014 | ..... | A47C 20/021 |

(Continued)

*Primary Examiner* — Eric J Kurilla
(74) *Attorney, Agent, or Firm* — Seyfarth Shaw LLP

(57) ABSTRACT

A body pillow has an elongate body formed around an axis. An outer cover of the pillow includes a stretchy circumferential band of material disposed around the axis and to be spaced from either end of the pillow. Ends of first and second inner pillows are disposed near or under the circumferential band. The user may helically twist the body of the pillow around the axis at the circumferential band. Doing so separates the inner pillows and increases their firmness. An inner side of the outer cover may be made of a stretchy fabric that conforms to the body of the user, while outer side may be composed mostly of nonstretch material to retain the pillows' shape. The twisted and nontwisted configurations of the pillow make it an effective sleeping aid for expecting mothers during different stages of their pregnancies.

36 Claims, 12 Drawing Sheets

(56) References Cited

U.S. PATENT DOCUMENTS

| | | | | |
|---|---|---|---|---|
| 7,353,551 | B2 | 4/2008 | Racovolis | |
| 7,430,774 | B2 | 10/2008 | Littlehorn et al. | |
| 7,472,443 | B2 | 1/2009 | Littlehorn et al. | |
| 7,540,050 | B1 * | 6/2009 | Nazer | A47C 20/025 5/632 |
| 7,793,371 | B1 | 9/2010 | Leach | |
| 7,810,191 | B2 | 10/2010 | Littlehorn et al. | |
| 8,136,186 | B1 | 3/2012 | Leach | |
| 8,468,627 | B2 | 6/2013 | Leach | |
| 8,646,134 | B1 * | 2/2014 | Alletto, Jr. | A47G 9/1036 5/636 |
| 8,671,480 | B1 | 3/2014 | Leach | |
| 8,863,334 | B2 | 10/2014 | Gibbons et al. | |
| 8,950,029 | B2 * | 2/2015 | Tidwell | A47G 9/10 5/655 |
| 9,021,635 | B1 * | 5/2015 | Leach | A47C 20/02 5/632 |
| 9,038,220 | B2 | 5/2015 | Aas-Jakobsen et al. | |
| 9,113,718 | B1 | 8/2015 | Leach | |
| 9,155,408 | B2 | 10/2015 | Alletto, Jr. | |
| 9,307,842 | B2 | 4/2016 | Gibbons | |
| 9,447,273 | B2 | 9/2016 | Casalini et al. | |
| 9,775,452 | B2 | 10/2017 | Gibbons et al. | |
| 9,872,576 | B2 | 1/2018 | Vitale | |
| 9,980,586 | B2 | 5/2018 | Alletto, Jr. | |
| 9,980,587 | B2 * | 5/2018 | Miller | A47G 9/10 |
| 10,098,475 | B2 | 10/2018 | Liran et al. | |
| 10,130,197 | B2 | 11/2018 | Erten | |
| 10,660,462 | B2 | 5/2020 | Grinstead | |
| 10,694,874 | B2 | 6/2020 | Fulkerson et al. | |
| 10,736,444 | B1 | 8/2020 | Leach | |
| 10,806,278 | B1 | 10/2020 | Leach | |
| 10,827,843 | B2 | 11/2020 | Miller | |
| 10,869,558 | B2 | 12/2020 | Liran et al. | |
| 10,898,007 | B1 | 1/2021 | Rozon | |
| 10,939,772 | B2 | 3/2021 | Stewart et al. | |
| 11,141,009 | B1 | 10/2021 | Rane | |
| 2001/0042271 | A1 | 11/2001 | Pearce | |
| 2007/0151031 | A1 * | 7/2007 | Leach | A47C 20/021 5/632 |
| 2007/0226909 | A1 * | 10/2007 | Goldman | A47G 9/10 5/636 |
| 2008/0010750 | A1 * | 1/2008 | Tidwell | A47D 13/083 5/643 |
| 2015/0089742 | A1 * | 4/2015 | Aas-Jakobsen | A47D 13/083 5/632 |
| 2016/0037946 | A1 * | 2/2016 | Melcher | A47C 20/021 |
| 2016/0166092 | A1 * | 6/2016 | Alletto, Jr. | A47G 9/0253 5/636 |
| 2017/0164754 | A1 * | 6/2017 | Alletto, Jr. | A47G 9/1036 |
| 2017/0367507 | A1 * | 12/2017 | Rakos | A47G 9/10 |
| 2018/0368592 | A9 * | 12/2018 | Rakos | A47C 20/027 |
| 2021/0068561 | A1 * | 3/2021 | Adeeb, Jr. | A47C 7/425 |

FOREIGN PATENT DOCUMENTS

| | | | | | |
|---|---|---|---|---|---|
| CA | 3186711 | A1 | * | 7/2023 | A47C 20/025 |
| CN | 203776538 | U | * | 8/2014 | A47C 20/025 |
| CN | 204032930 | U | * | 12/2014 | A47C 20/023 |
| CN | 105520449 | A | * | 4/2016 | |
| CN | 106562623 | A | * | 4/2017 | |
| CN | 206964465 | U | * | 2/2018 | |
| CN | 107752621 | A | * | 3/2018 | |
| KR | 200493969 | Y1 | * | 7/2021 | |
| KR | 102330039 | B1 | * | 11/2021 | |
| TW | M590923 | U | * | 2/2020 | |
| WO | WO-2006115994 | A1 | * | 11/2006 | A47C 20/02 |

* cited by examiner

BODY PILLOW

BACKGROUND OF THE INVENTION

A body pillow is meant to lay alongside a sleeper's body rather than just be underneath his or her head. A typical mattress presents a flat plane as its upper surface and will cushion only a part of a sleeper's body, such as his or her front, back or one side. A body pillow lends additional lateral support.

Body pillows have been provided for use by pregnant women who otherwise may experience discomfort while attempting to sleep. One form of these body or pregnancy pillows has a length much greater than its thickness. However, pregnancy pillows currently on the market have drawbacks. They often take up too much room in the bed, do not stay in place, do not permit the use of a conventional head pillow, are itchy, have exposed and irritating zippers, have shapes or firmnesses that cannot be easily altered, and/or are stuffed with a fill that gets lumpy and poorly distributed over time. Optimally, a pregnancy pillow should be long enough to support the belly and knees/legs at the same time, should be easy for the user to position both herself and the pillow, should be able to be easily altered in shape as the user's body changes shape, should have a firmness that can be changed for different parts of the body, and should permit the user to use her own head pillow. The body pillow described herein provides these advantages.

SUMMARY OF THE INVENTION

According to one aspect of the invention, a body pillow is provided that has a pillow body defined by an elongate outer cover. The outer cover has a circumferential band that is formed around a long axis of the pillow body, and so as to be spaced from both first and second opposed ends of the outer cover. This circumferential band is composed of a stretch fabric. The body further includes first and second inner pillows that are disposed inside of the outer cover. A first end of the first inner pillow is disposed near the first end of the outer cover. A second end of the first inner pillow is disposed to be near the circumferential band. A first end of the second inner pillow is disposed to be near the circumferential band. A second end of the second inner pillow is disposed to be near the second end of the outer cover.

The body pillow is capable of assuming each of a nontwisted configuration and a twisted configuration. In the twisted configuration, the outer cover is helically twisted around the axis at the circumferential band. This pushes apart the second end of the first inner pillow from the first end of the second inner pillow. It also increases the firmness of the first and second inner pillows. In the nontwisted configuration, the outer cover is not helically twisted about its axis. In one embodiment, the body pillow may be helically twisted by varying amounts to suit the user. One of these amounts can be 360 degrees.

According to another aspect of the invention, a body pillow has an elongate outer cover defining a pillow body, the pillow body being formed around along a longitudinal axis. The outer cover has an inner side that in use faces a torso of the user and an opposed outer side for facing away from the torso of the user. The inner side extends from a first side margin of the outer cover to a second side margin of the outer cover. A first, stretch fabric makes up at least a majority of the inner side. An outer side also extends from the first side margin to the second side margin. A second, nonstretch fabric makes up at least a majority of the outer side.

In one embodiment, the outer cover has a first end disposed on the axis and a second end disposed on the axis to be remote from the first end. The outer cover has a circumferential band of stretch fabric that is disposed around the axis so as to be between the first end and the second ends. Substantially all of the inner side of the outer cover is composed of stretch fabric. Substantially all of the outer side, with the exception of the circumferential band, is composed of nonstretch fabric.

In one embodiment, the pillow is capable of being helically twisted about its longitudinal axis by about 360 degrees, so that in the twisted configuration only stretchy fabric will face the torso of the user.

In either of the above aspects of the invention, a width of the circumferential band, when the body pillow is in the nontwisted configuration and as measured in a direction parallel to the axis, is less than about a tenth of an overall length of the body pillow, as measured between the first and second ends thereof in parallel to the axis.

In either of the above aspects of the invention, the outer cover is composed of a plurality of fabric panels. These fabric panels include the circumferential band and at least one panel made out of nonstretch fabric. In one embodiment, the outer cover has at least two such panels made out of nonstretch fabric.

In either of the above aspects of the invention, the circumferential band may be positioned closer to the first end of the outer cover than to the second end of the outer cover. In these embodiments, an axial length of the first inner pillow will be shorter than an axial length of the second inner pillow. Alternatively, the circumferential band may be positioned approximately equidistantly between the first end and the second end of the outer cover, and in this case the axial lengths of the inner pillows will be about the same.

In either of the above aspects of the invention, the body pillow is tapered from the second end of the outer cover to the first end of the outer cover. In one embodiment, the tapering occurs in a horizontal plane, but not in a vertical plane. Said another way, a thickness of the body pillow from a midline on the inner side to a midline on the outer side tapers as one proceeds from the second end of the outer cover to the first end of the outer cover, but the thickness from a top margin or seam to a bottom margin or seam remains substantially constant along most of the length of the outer cover. In one embodiment, the outer cover has a further, end panel, disposed at the second end, which is made of nonstretch fabric.

In either of the above aspects of the invention, first and second inner pillows are disposed inside of the outer cover, and may be filled with expanded polystyrene (EPS) microbeads.

The body pillow enables the use of a method for enhancing the comfort of a pregnant woman, during both a first time during her pregnancy and a second time during her pregnancy that is spaced from the first time. At the first time, the body pillow may be used in an untwisted configuration. At the second time, the user helically twists the body pillow, about its axis and at the outer cover's circumferential band of stretchy material, by a desired amount. In the twisted configuration, the spacing between the first and second inner pillows is increased, and/or the firmness of each of the first and second inner pillows is increased. The user then sleeps with the body pillow in the twisted configuration. In one embodiment, the user helically twists the pillow a full 360-degrees about the axis, so that stretchy material continues to face her torso.

The pillow of the present invention enhances the support of the user's knees or legs, and increases the ability of the user to adjust and customize pillow firmness. Because of the pillow's technical advantages, the user gets a better night's sleep, especially during pregnancy when the shape and weight of her body changes.

BRIEF DESCRIPTION OF THE DRAWINGS

Further aspects of the invention and their advantages can be discerned in the following detailed description as read in conjunction with the drawings of exemplary embodiments, in which like characters denote like parts and in which:

FIG. 19 is a top view of a second inner pillow for use in the embodiment shown in

FIG. 17;

DETAILED DESCRIPTION

Figure 1:
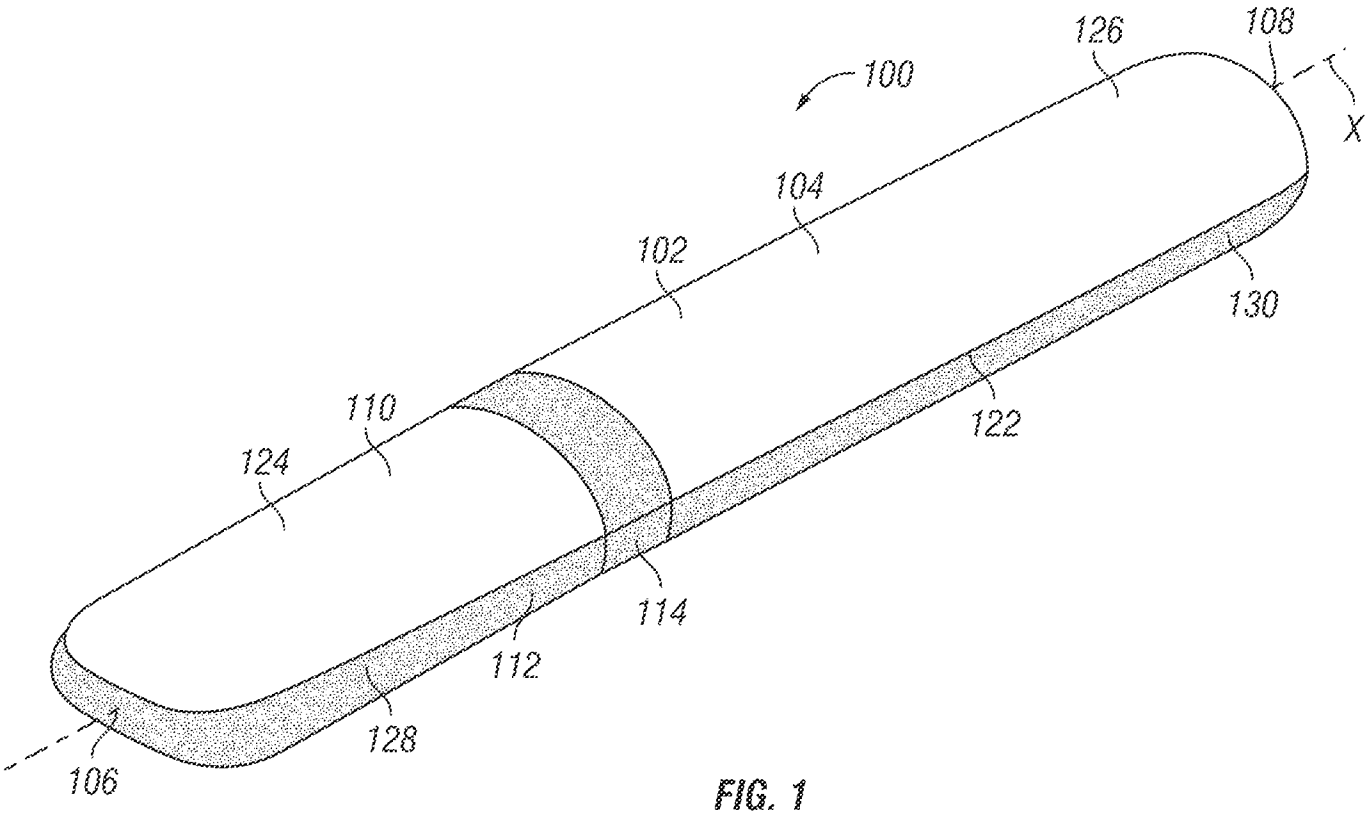
FIG. 1 is a perspective view, from a viewpoint near an outer side and a first end, of a first embodiment of a pillow according to the invention.
Figure 2:
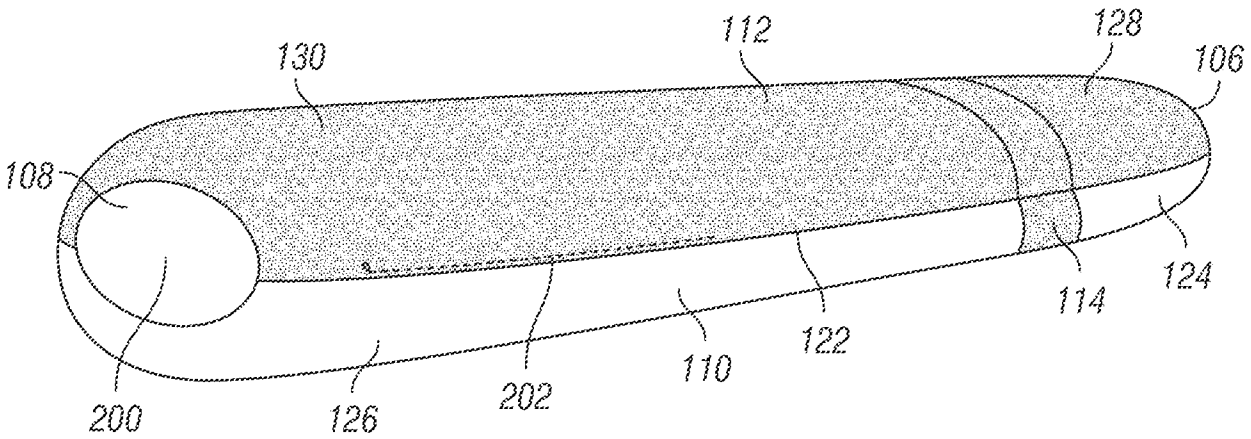
FIG. 2 is a perspective view, from a viewpoint near an inner side and a second end, of the pillow shown in FIG. 1.

As seen in FIG. 1, a body pillow 100 according to a first embodiment of the invention is formed around a longitudinal axis X. An outer cover 102 of pillow 100 defines the limits of a body 104 thereof, and extends from a first end 106 to a second end 108 remote from the first end 106. Ends 106, 108 are positioned on axis X. In overall dimensions, the body pillow is much longer than it is either wide or tall. For example, a length of body pillow 100, from end 106 to end 108 measured in parallel to axis X, can be about 54 inches. A height, as measured in a vertical plane when the pillow is put in use, can be consistent along most of the pillow's length. However, and as seen in FIG. 5, the pillow 100 is tapered, in a horizontal direction between an outer side 110 to an inner side 112, as one proceeds from the second end 108 to the first end 106. A greatest diameter of the second end 108, in a plane orthogonal to axis X, may be about 10 inches. Herein, I use "inner side" to mean the side that in use faces the torso of the mother, and "outer side" to mean the opposed side that in use faces away from the torso of the mother. But as seen in FIGS. 3 and 4, in a horizontal plane, the pillow 100 is not tapered throughout most of its length, but just rounded on the ends.

Figure 3:
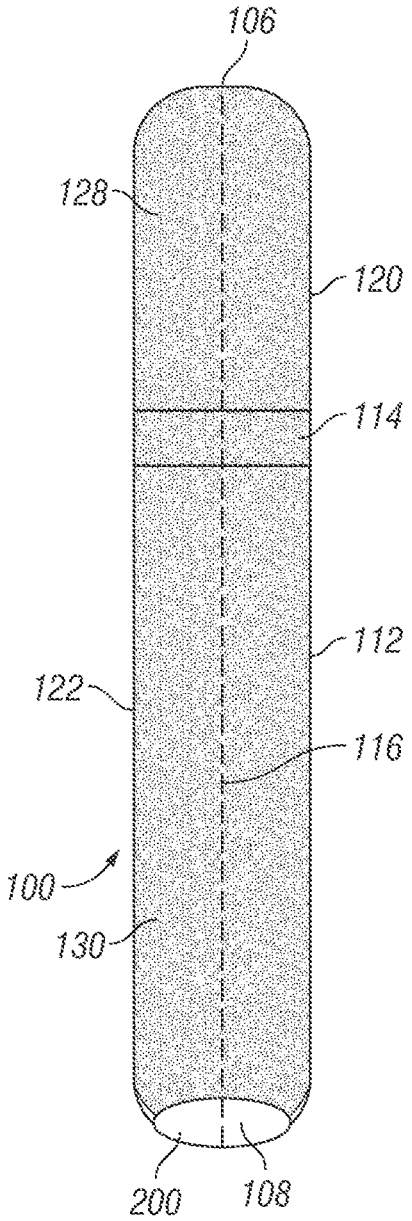
FIG. 3 is an inner side view of the pillow shown in FIG. 1.
Figure 4:
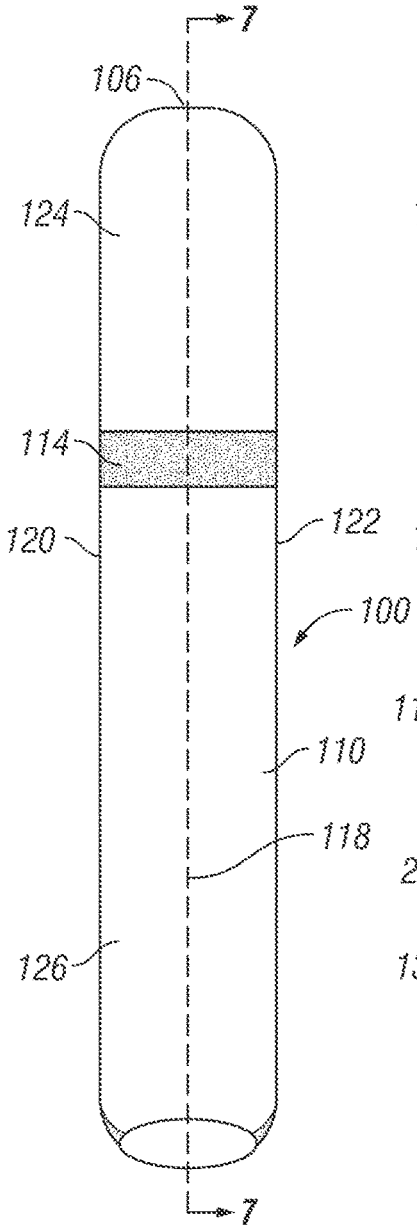
FIG. 4 is an outer side view of the pillow shown in FIG. 1.
Figure 5:
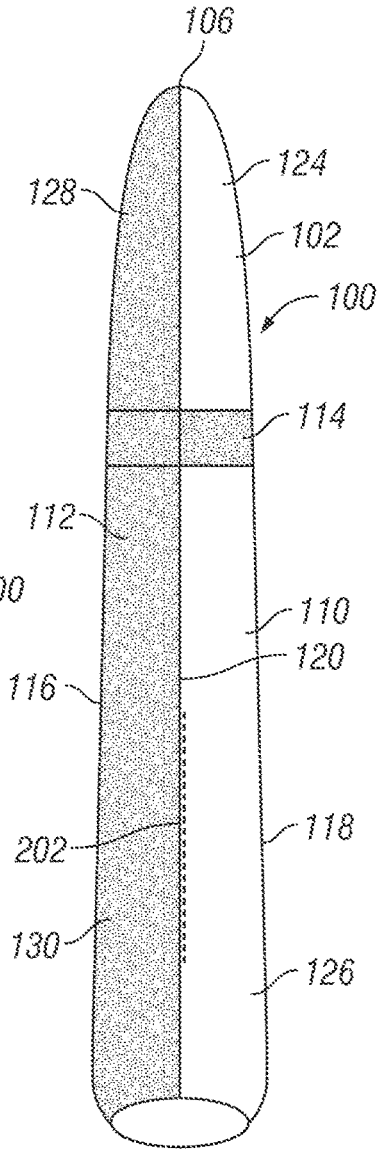
FIG. 5 is a top view of the pillow shown in FIG. 1.
Figure 6:
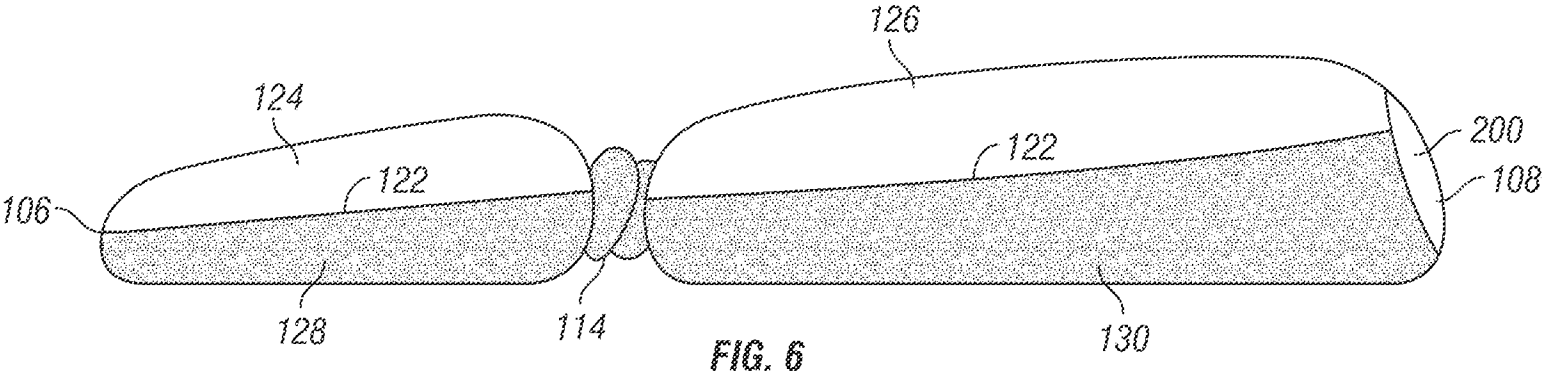
FIG. 6 is a top view of the pillow shown in FIG. 1, but shown in a twisted configuration.

Stated another way, and referring to FIGS. 3-5, the inner side 112 has an imaginary midline 116 that extends between ends 106, 108 and bisects inner side 112. The outer side 110 likewise has an imaginary midline 118 that likewise extends between ends 106 and 108, and bisects outer side 110. The inner side 112 is joined to the outer side 110, as by stitching, at a top seam or margin 120, and also at an opposed, bottom seam or margin 122. As one proceeds along the pillow body 104 from second end 108 to first end 106, the distance between outer midline 118 and inner midline 116 decreases, but the distance between top margin 120 and bottom margin 122 does not, except near either end 106, 108.

A circumferential band 114 of material is disposed around axis X, at a location between ends 106 and 108. In the embodiment seen in FIGS. 1-16D, this location is closer to the first end 106 than it is to the second end 108. For example, one edge of band 114 may be disposed at about 16½ inches from end 106. The width of band 114, as measured in a direction parallel to axis X, can be less than a tenth of the overall length of pillow 100, and in this illustrated embodiment is about three inches. The width of band 114 is selected to be the minimum necessary to allow at least a 360 degree helical twisting of the pillow 100 around axis X at the band 114.

To accommodate this degree of helical twisting, the circumferential band 114 is made of a stretchy material. In one embodiment, this can be a stretchy material with a soft pile, such as a nylon/Spandex jersey. The rest of outer side 110 preferably is composed of a smooth, soft but nonstretch material, such as a TENCEL® weave. TENCEL® is a trademark for a rayon fabric made of lyocell and modal fibers. In one embodiment, the remaining panels of stretchy fabric described herein are made of nylon/Spandex jersey, and the remaining panels of nonstretch fabric described herein are made of TENCEL®.

In the illustrated embodiment, a first panel 124 of nonstretch material extends from band 114 to end 106, and extends between seams 120 and 122. A second panel 126 of nonstretch material extends from band 114 to end 108, and between seams 120 and 122. As more clearly seen in FIGS. 2 and 3, a second panel 128 of stretch material extends between band 114 and end 106, and between seams 120 and 122. A third panel 130 of stretch material extends between band 114 and end 108 and between seams 120 and 122. The result is that, in the illustrated embodiment, all of inner side 112 is a soft stretch material, while most of the outer side 110 is composed of nonstretch material. As constructed of the preferred materials, the inner side 112 conforms to the user's body and particularly her belly, will be inherently cool to the touch, and is highly breathable and comfortable. The outer side 110 will be smooth, will absorb moisture better than cotton, and regulates heat. The outer side 110 keeps the pillow 100's support and shape.

The outer cover 102 is completed by an end panel 200 (FIG. 2), which can be made of a nonstretch material and which can take the shape of an oval or disk. It is preferred that all panels recited herein be joined together by stitching at hidden (interior facing) seams. A zipper 202 may be placed along the seam or margin 120 to permit the user to insert and extract the inner pillows, described below. The zipper 202 should be provided with a covering flap (not shown).

In one embodiment, the panels of the outer cover 102 are color-coded. For example, the color of the circumferential band 114 can be made to be in a color different from the rest of the panels of the cover. This is to provide the user a visual clue as to where to twist the pillow. In another embodiment, stretch panels 114, 128 and 130 may be provided in a first color, while nonstretch panels 124, 126 and 200 may be provided in another color. In a third embodiment, the color of circumferential band 114 may be chosen to be different from the color of nonstretch panels 124, 126 and 200, and also to be different in color from the rest of the stretch panels 128 and 130. In a fourth embodiment, the color of all panels is the same.

Figure 10:
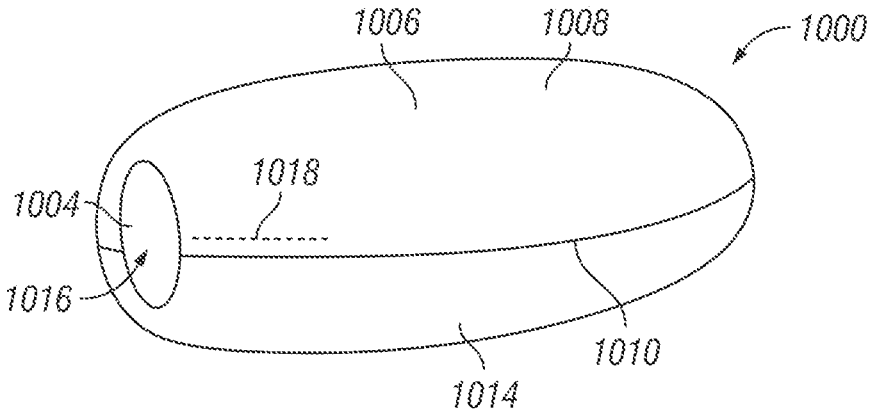
FIG. 10 is a perspective view, taken from near a second end thereof, of a first inner pillow for use in the embodiment shown in FIG. 1.
Figure 11:
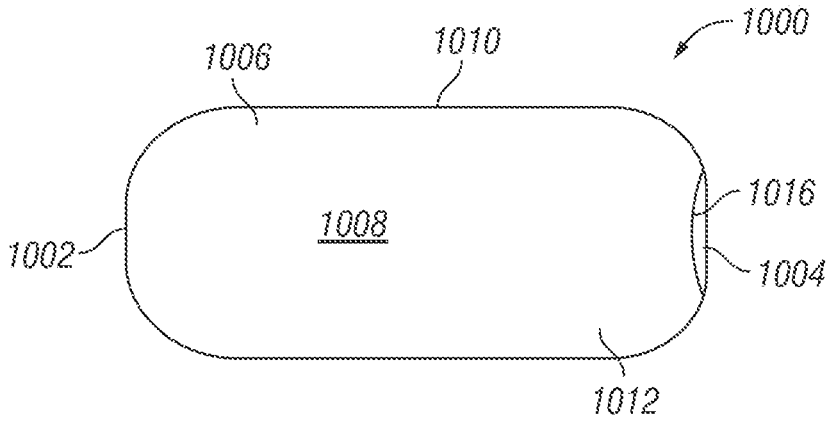
FIG. 11 is a side view of a first inner pillow for use in the embodiment shown in FIG. 1.
Figure 12:
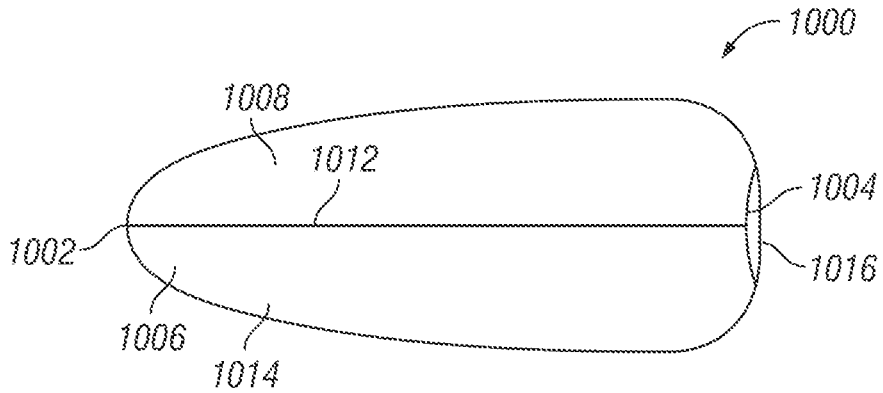
FIG. 12 is a top view of the first inner pillow shown in FIG. 10.

In the embodiment of the invention where circumferential band 114 is closer to end 106 than it is to end 108, two inner pillows 1000, 1300 are provided to be of different lengths. A first, smaller, inner pillow 1000 is shown in FIGS. 10-12. Pillow 1000 has a first end 1002 that, in use, will be adjacent to outer cover end 106. A second end 1004 is remote from first end 1002 and, in use, will be disposed near or under circumferential band 114. Inner pillow 1000 can be tapered from second end 1004 to first end 1002. Preferably, the taper is selected such that it conforms to the degree and type of taper of the outer cover 102.

In the illustrated embodiment, a cover 1006 of the first inner pillow 1000 is made from an inner panel 1008 that extends from end 1002 to end 1004 and from a bottom seam 1010 to a top seam 1012; an outer panel 1014 that also extends from end 1002 to end 1004 and from top seam 1012 to bottom seam 1010; and a preferably elliptical end panel 1016, the margins of which are stitched to inner panel 1008 and outer panel 1014. Panels 1008, 1014 and 1016 can be made of nonstretch fabric. A zipper 1018 is located on seam 1010 (alternatively but not shown, on seam 1012) to permit access to the interior of first inner pillow 1000. The zipper may have its pull removed and covered by a flap of fabric (not shown) to reduce irritation to the user. First inner pillow 1000 may be about eighteen inches long. Its end panel 1016 may take the form of an ellipse in which a major axis is disposed vertically in use and which may be about nine inches. A minor axis of end panel 1016 is disposed horizontally in use and may be about five inches. In conformance with the nature of the taper of outer cover 102, first inner pillow 1000 is tapered in a horizontal plane but not in a vertical plane, as is evident in FIGS. 11 and 12.

Figure 13:
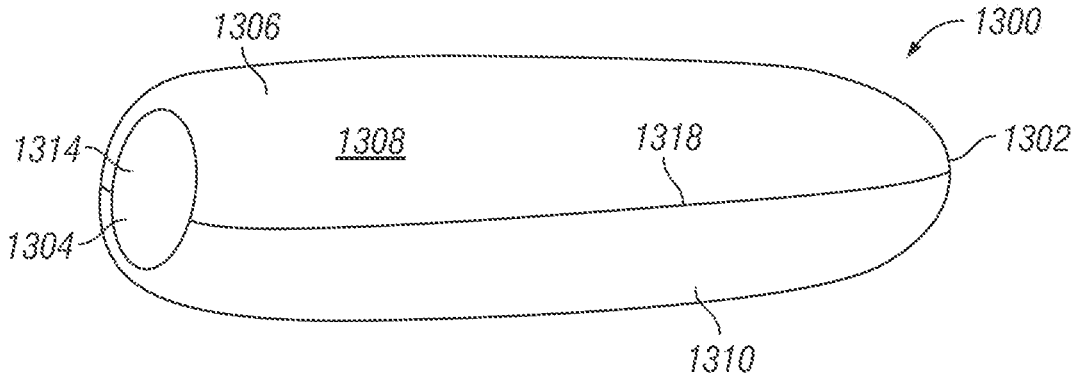
FIG. 13 is a perspective view, taken from near a second end thereof, of a second inner pillow for use in the embodiment shown in FIG. 1.
Figure 14:
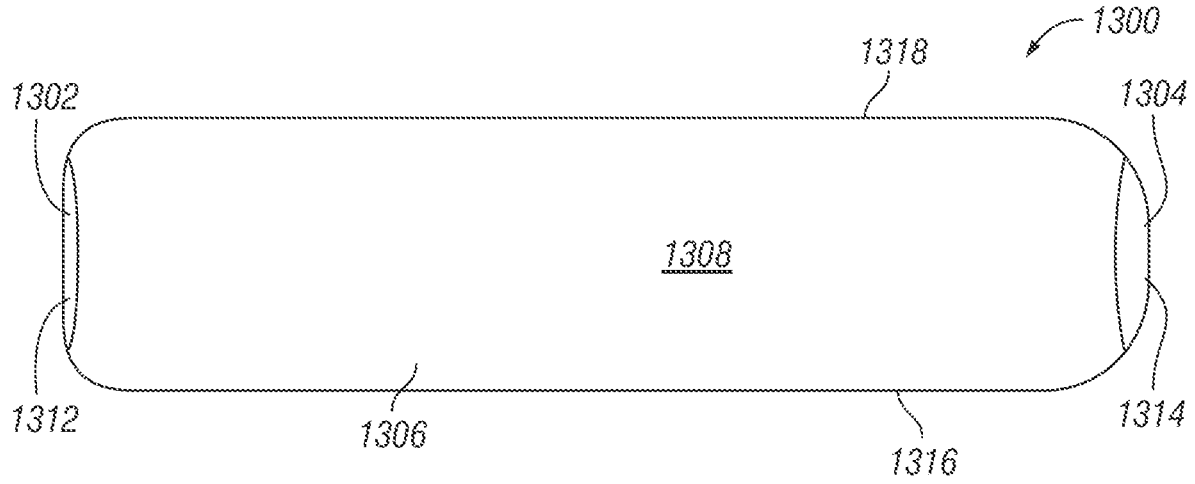
FIG. 14 is a side view of the second inner pillow shown in FIG. 13.
Figure 15:
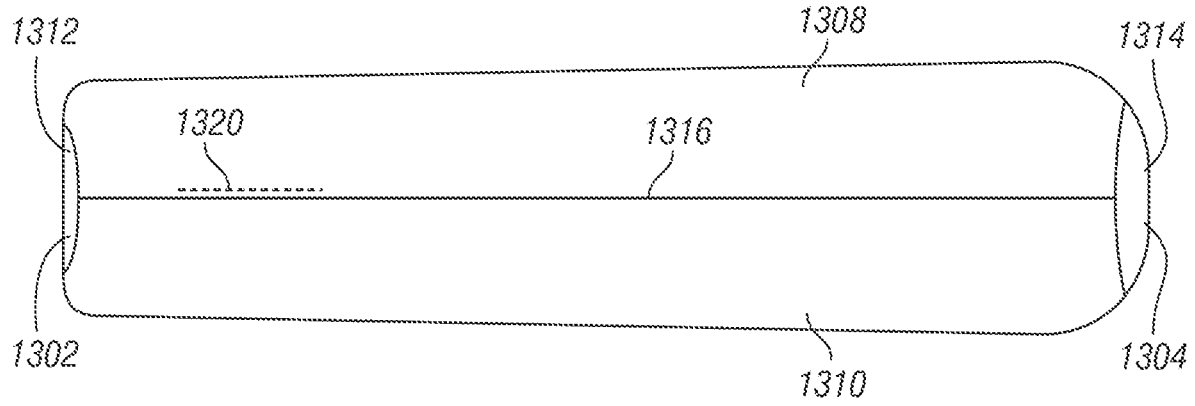
FIG. 15 is a top view of the second inner pillow shown in FIG. 13.

The second inner pillow 1300 is illustrated in FIGS. 13-15. The second inner pillow 1300 extends from a first end 1302, which in use is disposed near or under the circumferential band 114 of outer cover 102, to a second end 1304, which in use is disposed to be adjacent the second end 108 of outer cover 102. In this illustrated embodiment, a cover 1306 of second inner pillow 1300 is made up of four fabric panels: an inner panel 1308, an outer panel 1310, a first end panel 1312 and a second end panel 1314. The inner panel 1308 extends from first end 1302 to second end 1304 and from a top seam 1316 to a bottom seam 1318. The outer panel 1310 likewise extends from first end 1302 to second end 1304 and from top seam 1316 to bottom seam 1318. First end panel 1312 is disposed at first end 1302 and may take the form of an ellipse, such as one having a major axis of about nine inches and a minor axis of about five inches. Second end panel 1314 is disposed at second end 1304 and may take the form of a disc with a diameter of about nine inches. An axial length of second inner pillow may be about 36 inches, in the embodiment illustrated in FIGS. 1-16D (in which the lengths of the first and second inner pillows are different from each other and in which circumferential band 114 is positioned closer to first end 106 than to second end 108).

The second inner pillow 1300 may be tapered from second end 1304 to first end 1302. The degree of taper preferably conforms to that of outer cover 102. Also to this end, the second inner pillow is tapered in a horizontal plane, as seen in FIG. 15, but not in a vertical plane, as seen in FIG. 14, except near ends 1302, 1304. Panels 1308, 1310, 1312 and 1314 may be made of a nonstretch fabric. A zipper 1320 may be positioned along seam 1316 (alternatively, along seam 1318) to afford access to the interior of second inner pillow 1300. Ideally the zipper 1320 should have its pull removed and should be covered by a fabric flap (not shown), so as to not be a source of irritation to the user.

First and second inner pillows 1000, 1300 may be filled with a fill 700 (FIGS. 7-9) such as expanded polystyrene (EPS) microbeads. The micro EPS beads may have an average diameter of about 1 mm. A micro EPS bead fill is easily adjustable and adaptable, is breathable, does not get hot, is lightweight and easy to maneuver, and feels plush and soft to the user.

Figure 7:
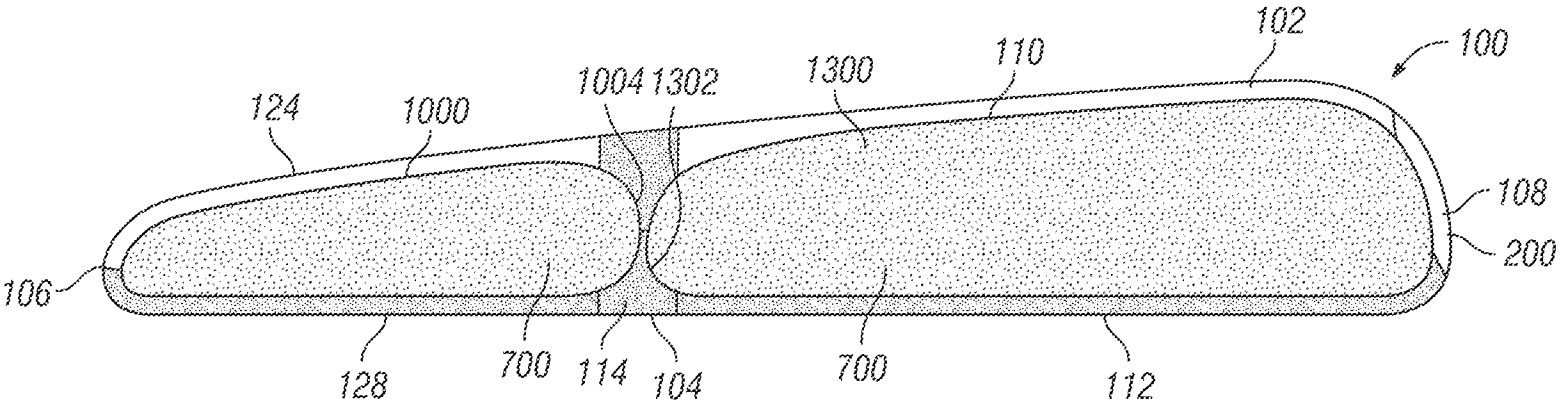
FIG. 7 is an axial sectional view taken along Line 7-7 of FIG. 4.
Figure 8:
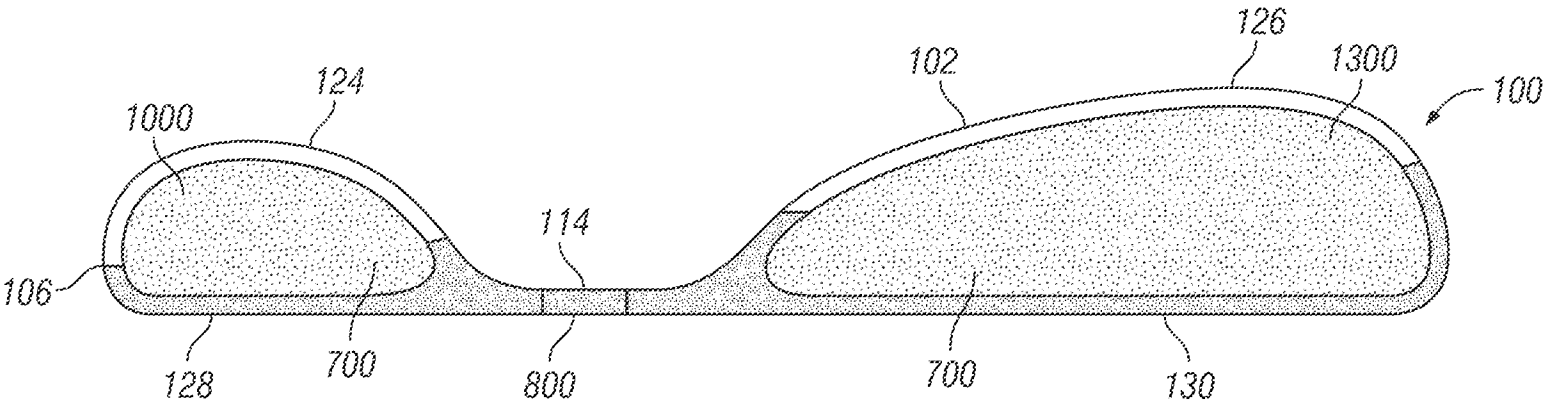
FIG. 8 is an axial sectional view of the pillow after the user has separated the first inner pillow from the second inner pillow.
Figure 9:
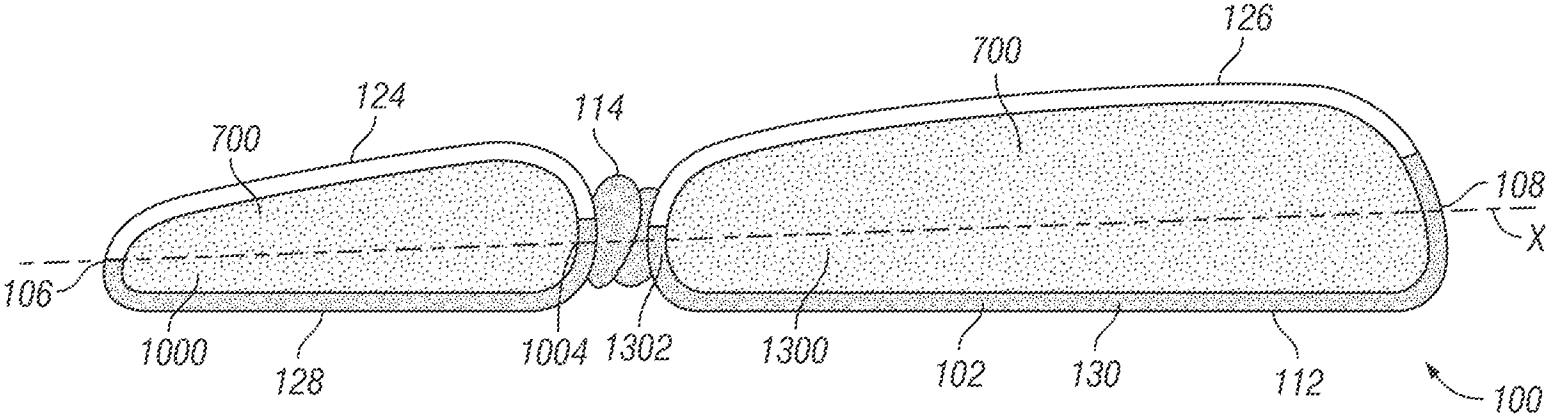
FIG. 9 is an axial sectional view of the pillow shown in FIG. 1, but shown in a twisted configuration.

FIGS. 7-9 show pillow 100 in a nontwisted configuration (FIG. 7), a twisted configuration (FIG. 9) and a transitional state between these configurations (FIG. 8). In FIG. 7, the second end 1004 of first inner pillow 1000 is adjacent or even touching first end 1302 of second inner pillow 1300, at a location underneath circumferential band 114. In FIG. 8, the user has pushed the fill 700 in first inner pillow 1000 away from the fill 700 in second inner pillow 1300, leaving a region 800 through which the outer cover is not supported by fill 700 at all. This region 800 should include circumferential band 114. In FIG. 9, the user has helically twisted outer cover 102 about axis X at circumferential band 114. The outer cover 102 may, for example, be twisted by a full 360 degrees, such that stretch panels 128 and 130 of the inner side 112 again face the torso of the user. This twisting will increase the separation of first inner pillow end 1004 from second pillow end 1302. The twisting also has the effect of increasing the firmness of fill 700 in pillows 1000, 1300. Helically twisting pillow 100 about its axis X keeps the inner pillows 1000, 1300 separated when the pillow 100 is in use.

Figure 16D:
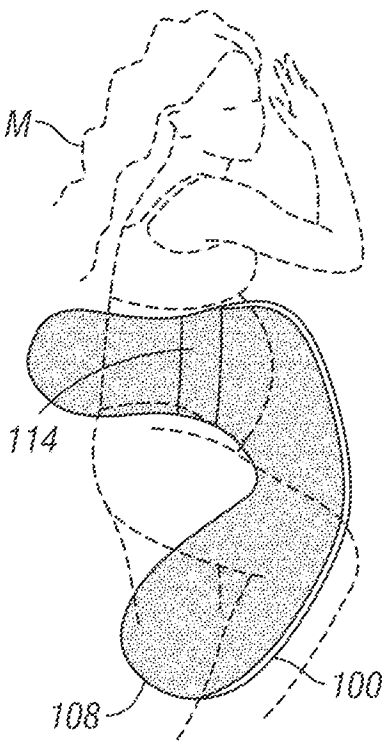
FIGS. 16A-16D show different possible positions of the body pillow used during sleep, a user being shown in phantom.
Figure 16C:
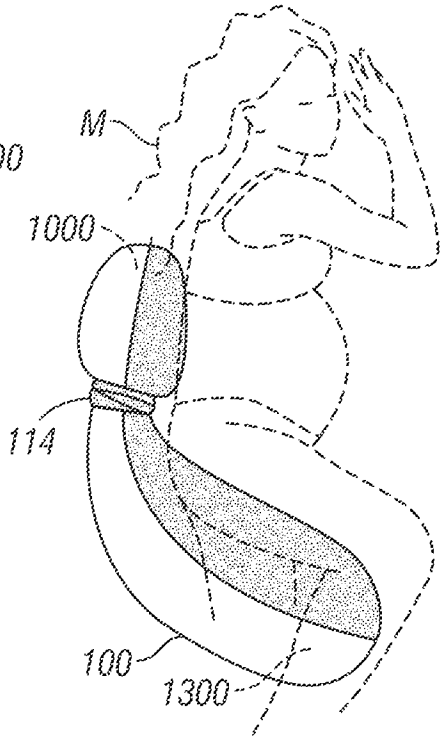
Figure 16B:
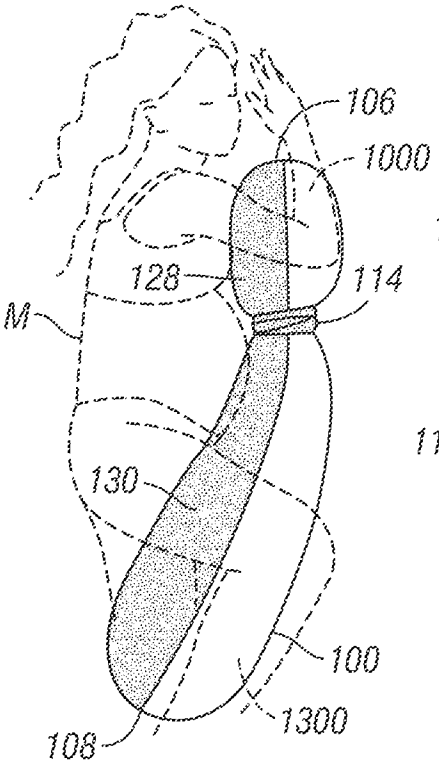
Figure 16A:
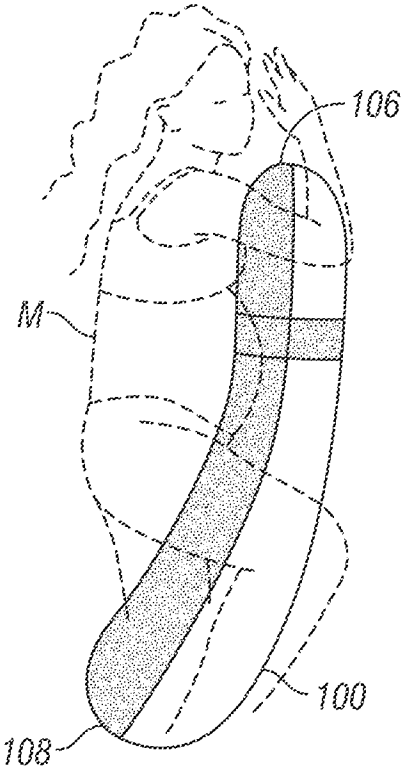

FIGS. 16A-16D depict use of the pillow 100 in various configurations. Note that while the pillow 100, and its inner pillows 1000, 1300, are formed along a straight, longitudinal axis X, in use they don't stay that way. In FIG. 16A, the pillow 100 is being used in an untwisted configuration. The first, smaller end 106 is positioned near the upper chest of mom M. The pillow 100 has been curved to conform to the torso of mom M's body, and the lower end 108 may be positioned between her legs. The utility of this configuration is enhanced because the pillow 100 is wider where it is inserted between the mom's legs, and is not as wide at that portion facing mom M's belly. In FIG. 16B, mom M is using pillow 100 in a similar way, but only after she has twisted pillow 100 at circumferential band 114. Since mom M has twisted the pillow through 360°, both of the stretchy inner panels 128, 130 remain proximate to her body. This increases the firmness and level of support contributed by inner pillows 1000, 1300. In FIG. 16C, the pillow 100 has been helically twisted at circumferential band 114 so as to increase the firmness of inner pillows 1000, 1300. As so configured, pillow 100 is used to support mom M's back. Finally, in FIG. 16D, pillow 100 is used in an untwisted configuration, but mom M is laying partially on top of it, with the lower end 108 padding mom M's knees and legs.

Figure 17:
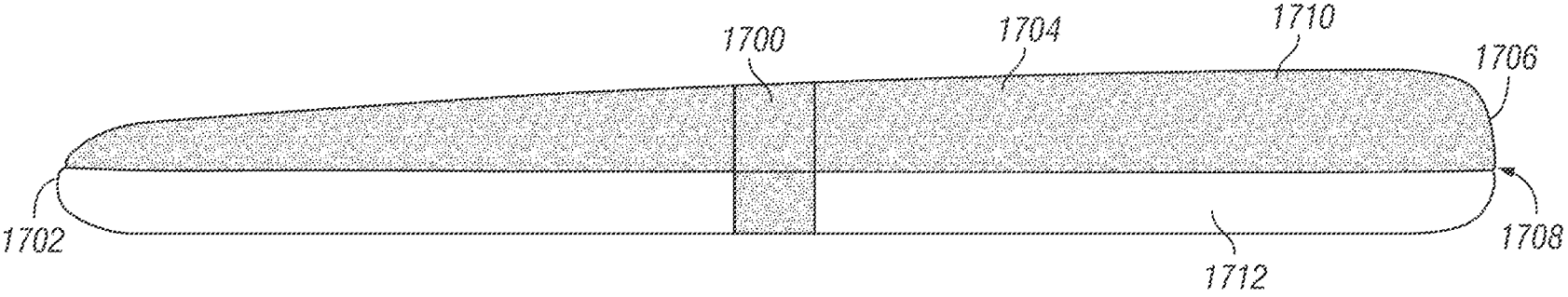
FIG. 17 is a top view of a body pillow according to a second embodiment of the invention.
Figure 19:
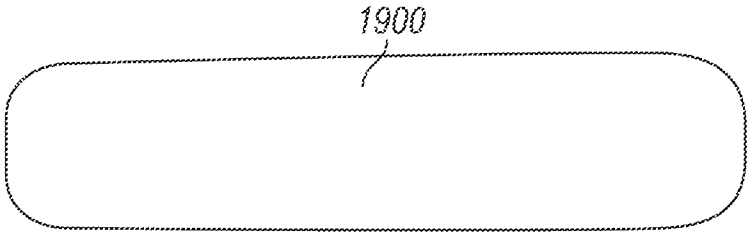
Figure 18:
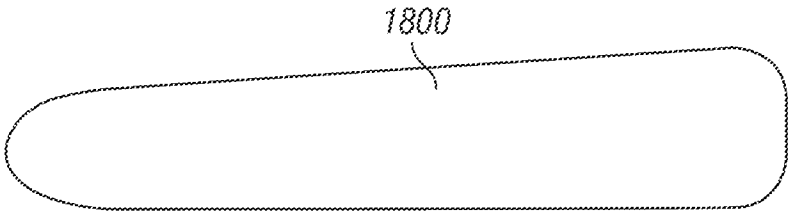
FIG. 18 is a top view of a first inner pillow for use in the embodiment shown in FIG. 17.
Figure 20:
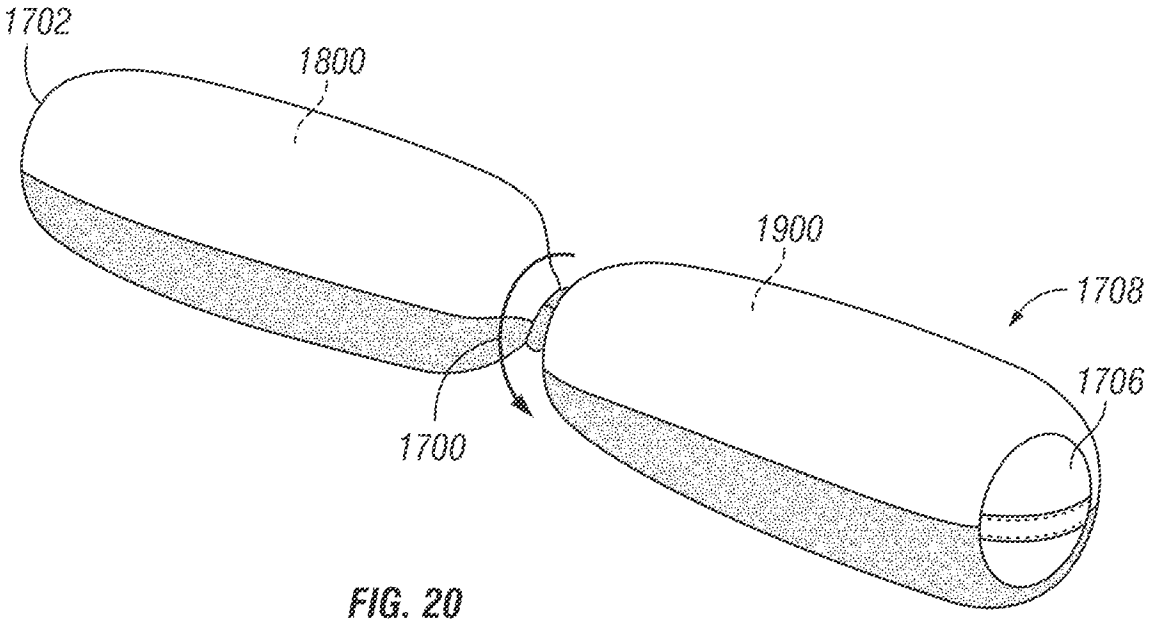
FIG. 20 is a perspective view of the pillow shown in FIG. 17, but in a twisted configuration.

FIGS. 17-19 illustrate an alternative embodiment, in which a circumferential band 1700 is located approximately equidistantly between a first end 1702 of the outer cover 1704, and a second end 1706 thereof. A first inner pillow 1800 is longer than the first inner pillow 1000 of the first embodiment, and a second inner pillow 1900 is commensurately shorter than the second inner pillow 1300. The materials from which alternative body pillow 1708 and its inner pillows 1800, 1900 are made otherwise can be the same, as can the overall degree and type of taper and the composition of the inner and outer sides 1710, 1712 of the outer cover 1704. First pillow 1800 has enough volume and length for arm support and belly support. Second inner pillow 1900 still has enough volume and length for knee and leg support. The degree of taper from second end 1706 to first end 1702 remains the same as that of the first illustrated embodiment, so that the user's belly can have low profile support but wider support for the user's knees and legs. The pillow 1708 remains helically twistable from a nontwisted configuration to a twisted configuration (see FIG. 20) and back, at circumferential band 1700, so that the user may adjust the firmness and/or placement of inner pillows 1800 and 1900.

Figure 21:
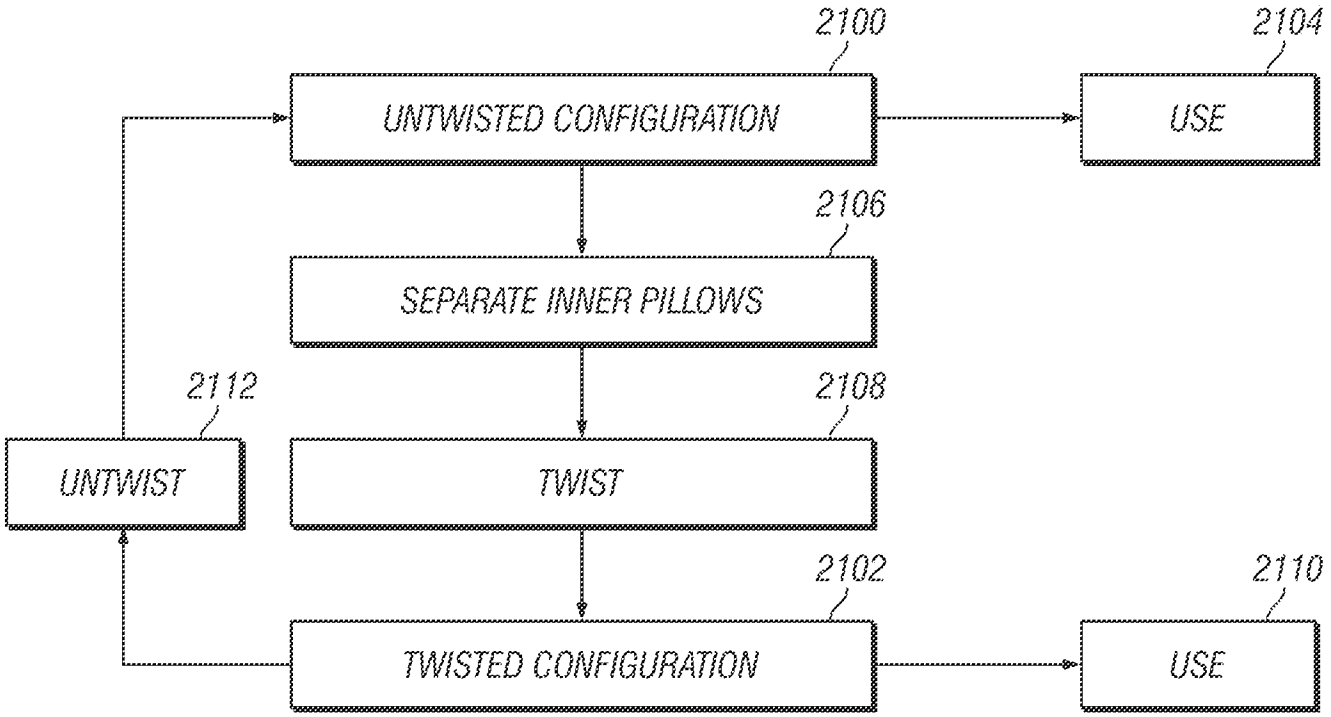
FIG. 21 is a block diagram illustrating steps in a method of use according to the invention.

FIG. 21 depicts steps in a method of using either pillow 100 or pillow 1708. The pillow may presently be in ether an untwisted configuration 2100, as seen in FIG. 7, or a twisted configuration 2102, seen in FIG. 9. If the pillow is presently in the untwisted configuration, the user only has to use it at step 2104. But the user may want to increase the firmness in the inner pillows. To do this, and at step 2106, she separates the inner pillows, and more particularly the fill 700 in those inner pillows, as seen in FIG. 8. Then, at step 2108, she helically twists the outer cover 102, 1704, possibly through about 360 degrees so that the stretchy material is again presented for conformance to her body. Doing this places the pillow in a twisted configuration at 2102, and the user may choose to use the pillow in this configuration at step 2110. To return the pillow to an untwisted configuration, the user simply untwists it at step 2112. The ability to so easily reconfigure the pillow makes it ideal as a sleeping aid for different stages or times during pregnancy.

In summary, a body pillow has been shown and described that is particularly suited as a sleeping aid during pregnancy. The user may helically twist the pillow at a stretchy circumferential band to increase the firmness of inner pillows disposed inside of the outer cover, or use the pillow in an untwisted configuration. The pillow is thus adaptable for use during different times during pregnancy.

While illustrated embodiments of the present invention have been described and illustrated in the appended drawings, the present invention is not limited thereto but only by the scope and spirit of the appended claims.

We claim:

1. A body pillow comprising:

an elongate outer cover defining a pillow body, the pillow body formed along a longitudinal axis, the outer cover having a first end disposed on the axis and a second end disposed on the axis to be remote from the first end;

the outer cover having a circumferential band formed around the axis, the circumferential band spaced from the first end of the outer cover and from the second end of the outer cover and composed of a stretch fabric;

a first inner pillow disposed inside of the outer cover, a first end of the first inner pillow disposed to be near the first end of the outer cover, a second end of the first inner pillow remote from the first end of the first inner pillow disposed to be near the circumferential band;

a second inner pillow disposed inside of the outer cover, a first end of the second inner pillow disposed to be near the circumferential band, a second end of the second inner pillow remote from the first end of the second inner pillow disposed to be near the second end of the outer cover; wherein the body pillow is capable of assuming each of a nontwisted configuration and a twisted configuration, wherein in the nontwisted configuration the outer cover is not helically twisted about the axis, and the second end of the first inner pillow is at a first distance from the first end of the second inner pillow; and wherein, in the twisted configuration, the outer cover is helically twisted about the axis at the circumferential band, and the second end of the first inner pillow is at a second distance from the first end of the second inner pillow, the second distance being greater than the first distance.

2. The body pillow of claim 1, wherein a width of the circumferential band, in the nontwisted configuration and as measured in a direction parallel to the axis, is less than a tenth of an overall length of the outer cover, in the nontwisted configuration and measured in a direction parallel to the axis.

3. The body pillow of claim 1, wherein a width of the circumferential band, in the nontwisted configuration and as measured in a direction parallel to the axis, is about three inches.

4. The body pillow of claim 1, wherein the body pillow is capable of being twisted at least about 360 degrees to assume the twisted configuration.

5. The body pillow of claim 1, wherein the outer cover is composed of a plurality of fabric panels including a panel making up the circumferential band, at least one fabric panel of the outer cover joined to the circumferential band being made of a nonstretch fabric.

6. The body pillow of claim 5, wherein at least two fabric panels of the outer cover joined to the circumferential band are made of nonstretch fabric.

7. The body pillow of claim 1, wherein the circumferential band is disposed around the axis to be closer to the first end than to the second end.

8. The body pillow of claim 7, wherein an axial length of the first inner pillow is shorter than an axial length of the second inner pillow.

9. The body pillow of claim 7, wherein the outer cover is tapered from the second end of the outer cover to the first end of the outer cover.

10. The body pillow of claim 9, wherein the outer cover has a length in the untwisted condition, and wherein an inner side of the outer cover, in use, faces the user and an outer side of the outer cover is remote from the user, the inner side extending from a first side margin of the outer cover to a second side margin of the outer cover, the outer side extending from the first side margin to the second side margin, the inner side having an axially oriented inner midline bisecting a surface of the inner side between the first side margin and the second side margin, the outer side having an axially oriented outer midline bisecting a surface of the outer side between the first side margin and the second side margin, a thickness of the body pillow in the untwisted condition between the first side margin and the second side margin remaining substantially constant throughout most of the length of the outer cover, a thickness of the body pillow in the untwisted condition between the inner midline and the outer midline tapering from the second end of the outer cover to the first end of the outer cover.

11. The body pillow of claim 1, wherein the circumferential band is disposed around the axis at a point approximately equidistant from the first end of the outer cover to the second end of the outer cover.

12. A body pillow comprising:

an elongate outer cover defining a pillow body, the pillow body formed along a longitudinal axis;

the outer cover having an inner side for facing the user and an outer side for positioning remote from the user, the inner side extending from a first side margin of the outer cover to a second side margin of the outer cover opposed to the first side margin, a first fabric making up at least a majority of the inner side, the first fabric being a stretch fabric;

the outer side extending from the first side margin to the second side margin, a second fabric making up at least a majority of the outer side, the second fabric being a nonstretch fabric, wherein the outer cover has a first end disposed on the axis and a second end disposed on the axis to be remote from the first end, a circumferential band of stretch fabric disposed around the axis and to be between the first end and the second end, substantially all of the inner side of the outer cover being composed of stretch fabric, substantially all of the outer side of the outer cover being composed of nonstretch fabric with the exception of the circumferential band.

13. The body pillow of claim 12, wherein the circumferential band is located at a position closer to the first end than the second end.

14. The body pillow of claim 12, wherein the circumferential band is located approximately equidistantly from the first end and the second end.

15. The body pillow of claim 12, wherein the inner side comprises a first inner side panel extending from the first end to the circumferential band and a second inner side panel extending from the second end to the circumferential band, the first and second inner side panels being made of a stretch fabric.

16. The body pillow of claim 12, wherein the outer side comprises a first outer side panel extending from the first end to the circumferential band and a second outer side panel extending from the second end to the circumferential band, the first and second outer side panels being made of a nonstretch fabric.

17. The body pillow of claim 12, wherein a first inner pillow and a second inner pillow are disposed inside the outer cover, the first inner pillow extending from the first end toward the circumferential band, the second inner pillow extending from the second end toward the circumferential band.

18. The body pillow of claim 17, wherein the first inner pillow has a first end disposed adjacent the first end of the outer cover and a second end disposed near the circumferential band, the first inner pillow tapering in thickness from the second end of the first inner pillow to the first end of the first inner pillow.

19. The body pillow of claim 17, wherein the second inner pillow has a first end disposed near the circumferential band and a second end disposed adjacent the second end of the outer cover, the second inner pillow tapering in thickness from the second end of the second inner pillow to the first end of the second inner pillow.

20. The body pillow of claim 12, wherein a first inner pillow and a second inner pillow are disposed inside the outer cover, each of the first and second inner pillows being filled with expanded polystyrene microbeads.

21. The body pillow of claim 12, wherein a first inner pillow and a second inner pillow are disposed inside the outer cover, a cover of the first inner pillow and a cover of the second inner pillow are composed of a nonstretch fabric.

22. The body pillow of claim 12, wherein the outer cover has a first end disposed on the axis and a second end disposed on the axis to be remote from the first end, an end panel disposed at the second end to join the inner side to the outer side at the second end, the end panel formed of nonstretch fabric.

23. The body pillow of claim 12, wherein the nonstretch fabric is composed of modal and lyocell fibers.

24. The body pillow of claim 12, wherein the stretch fabric is nylon/spandex.

25. A body pillow comprising:

an elongate outer cover defining a pillow body, the pillow body formed along a longitudinal axis;

the outer cover having an inner side for facing the user and an outer side for positioning remote from the user, the inner side extending from a first side margin of the outer cover to a second side margin of the outer cover opposed to the first side margin, a first fabric making up at least a majority of the inner side, the first fabric being a stretch fabric;

the outer side extending from the first side margin to the second side margin, a second fabric making up at least a majority of the outer side, the second fabric being a nonstretch fabric, wherein the outer cover has a first end disposed on the axis and a second end disposed on the axis to be remote from the first end, the outer cover tapering from the second end to the first end.

26. The body pillow of claim 25, wherein the outer cover has a length, an inner side of the outer cover, in use, facing the user and an outer side of the outer cover being remote from the user, the inner side extending from a first side margin of the outer cover to a second side margin of the outer cover, the outer side extending from the first side margin to the second side margin, the inner side having an axially oriented inner midline bisecting a surface of the inner side between the first side margin and the second side margin, the outer side having an axially oriented outer midline bisecting a surface of the outer side between the first side margin and the second side margin, a thickness of the body pillow between the first side margin and the second side margin remaining substantially constant throughout most of the length of the outer cover, a thickness of the body pillow between the inner midline and the outer midline tapering from the second end of the outer cover to the first end of the outer cover.

27. The body pillow of claim 25, wherein a first inner pillow and a second inner pillow are disposed inside of the outer cover.

28. The body pillow of claim 27, wherein:

the first inner pillow has a first end disposed adjacent the first end of the outer cover and a second end opposed to the first end of the first inner pillow;

the first inner pillow tapers in thickness from the second end of the first inner pillow to the first end of the first inner pillow.

29. The body pillow of claim 27, wherein:

the second inner pillow has a second end disposed adjacent to the second end of the outer cover and a first end opposed to the second end of the inner pillow;

the second inner pillow tapers in thickness from the second end of the second inner pillow to the first end of the inner pillow.

30. The body pillow of claim 27, wherein each of the first and second inner pillows are filled with expanded polystyrene microbeads.

31. The body pillow of claim 27, wherein a first cover for the first inner pillow and a second cover for the second inner pillow are composed of nonstretch fabric.

32. The body pillow of claim 25, wherein:

an end panel of the outer cover is disposed on the second end of the outer cover and joins the inner side of the outer cover to the outer side of the outer cover at the second end; and the end panel is formed of nonstretch fabric.

33. The body pillow of claim 25, wherein the nonstretch fabric is composed of modal and lyocell fibers.

34. The body pillow of claim 25, wherein the stretch fabric is nylon/spandex.

35. A method of using a body pillow to enhance the comfort of a pregnant woman during a first time and during a second time spaced from the first time, the method including the steps of:

providing an elongate body pillow to have a first end on an axis, a second end on the axis to be remote from the first end, and a circumferential band disposed around the axis and being made of a stretch fabric, the circumferential band spaced from the first end and the second end, the circumferential band being part of an outer cover of the body pillow, the body pillow further having a first inner pillow disposed inside the outer cover between the first end and the circumferential band and a second inner pillow disposed inside of the outer cover between the second end and the circumferential band;

at the first time, using the body pillow in an untwisted configuration;

at the second time, helically twisting the pillow at the circumferential band to a twisted configuration, thereby increasing the spacing between the first and second inner pillows and/or increasing a firmness of the first and second inner pillows; and at the second time, using the body pillow in the twisted configuration.

36. The method of claim 35, wherein:

the body pillow has an inner side composed of at least a stretch fabric, and an outer side composed of at least a nonstretch fabric, helically twisting the pillow comprises twisting the body pillow approximately 360 degrees around the axis.

* * * * *